US006562018B1

(12) United States Patent
Russell

(10) Patent No.: US 6,562,018 B1
(45) Date of Patent: May 13, 2003

(54) PELVIC FLOOR MUSCLE EXERCISER

(76) Inventor: Yvonne Russell, 85 Ocean Park Loop, Georgetown, SC (US) 29440

( * ) Notice: Subject to any disclaimer, the term of this patent is extended or adjusted under 35 U.S.C. 154(b) by 107 days.

(21) Appl. No.: 09/690,517

(22) Filed: Oct. 17, 2000

(51) Int. Cl.[7] ..... A61M 31/00
(52) U.S. Cl. ..... 604/500; 604/105
(58) Field of Search ..... 482/105, 91, 93, 482/108, 109; 604/500

(56) References Cited

U.S. PATENT DOCUMENTS

| | | | | |
|---|---|---|---|---|
| 4,241,912 A | | 12/1980 | Mercer et al. | 272/125 |
| 4,574,791 A | * | 3/1986 | Mitchener | 482/122 |
| 4,895,363 A | | 1/1990 | Plevnik et al. | 272/93 |
| 5,291,902 A | | 3/1994 | Carman | 607/138 |
| 5,407,412 A | | 4/1995 | Plevnik et al. | 482/105 |
| 5,554,092 A | | 9/1996 | Harpstead et al. | 482/148 |
| 5,733,230 A | | 3/1998 | Sawchuck et al. | 482/111 |
| 6,063,045 A | | 5/2000 | Wax et al. | 600/591 |
| 6,068,581 A | | 5/2000 | Anderson | 482/93 |
| D447,563 S | * | 9/2001 | Stein | D24/133 |

FOREIGN PATENT DOCUMENTS

| | | |
|---|---|---|
| GB | 2058571 | 4/1981 |
| GB | 2272168 | 5/1994 |
| WO | WO9908560 | 2/1999 |

* cited by examiner

*Primary Examiner*—Edward K. Look
*Assistant Examiner*—Kimya N McCoy
(74) *Attorney, Agent, or Firm*—Michael A Mann; Nexsen Pruet Jacobs & Pollard LLC

(57) ABSTRACT

An apparatus for exercising pelvic floor muscles is provided that allows the user to adjust the force against which she must act so as to maximize the effect of the exercise. The apparatus of the present invention comprises a shaft having a proximal end and a distal end. Attached to said proximal end of said shaft is an intra-vaginal portion designed for the user to contract her pelvic floor muscles against and attached to said distal end of said shaft is a grasping means by which the user may apply variable force so as to maximize the force against which the user's contracted pelvic floor muscles must resist.

17 Claims, 2 Drawing Sheets

PELVIC FLOOR MUSCLE EXERCISER

BACKGROUND OF THE INVENTION

The present invention relates to an apparatus for exercising pelvic floor muscles. More particularly, the present invention relates to an apparatus for exercising pelvic floor muscles that allows for constant resistance and feedback to the user.

Exercises for perineal muscles, also known as pelvic floor muscles, are often recommended as therapy to aid correction of a number of problems including but not limited to urinary incontinence or physical stress incontinence. Other common problems resulting from lack of proper or adequate toning of the pelvic floor muscles include fallen bladder, fallen rectum, uterine prolapse, difficulties with voiding, cystitis, decreases in sexual responsiveness and chronic discomfort. Absent a routine exercise program lack of muscle tone can result in muscle atrophy thereby resulting in an exacerbation of the above conditions and could require a variety of surgical corrections.

It is well documented that a regular exercise program involving this muscle group can result in improved muscle tone resulting in a concomitant improvement in voluntary muscle control, increased strength and re-enervation of previously injured muscles. Such an exercise program can enhance sexual responsiveness and pleasure of both partners during intercourse. Moreover, it is known that improved muscle tone resulting from such an exercise routine is desirable in preparation for childbirth. Use of the device postpartum shortens healing time and hastens the return of tone of the pelvic region. The same is true post-hysterectomy.

Numerous intra-vaginal devices have been described, some ranging from the complex to the simple. These simple devices generally involve the use of weights which are attached to that portion of the device that is extra-vaginal. Such weights apply constant pressure and rely on gravity as the operating means. The user of these devices contracts her pelvic floor muscles around the intra-vaginal portion of the device and thereby provides resistance to the force applied by the weights. It is that resistance that enhances muscle tone.

These devices, however, have several shortcomings. To begin with, use of weights, of necessity, mandates that the amount of force against which the user can act may be increased or decreased in discrete weight units. That is to say, continuously varying the force in order to maximize the effects of the exercise is not possible with discrete weights.

Another shortcoming of the devices of the present invention is that in certain circumstances, such as partial paralysis, the user is not capable or does not desire to use the device in a manner which allows for the application of force due to gravity. That is to say, in the devices relying on gravity as the force inducer the device must be generally aligned so that the extra-vaginal portion of the device can be aligned in a generally perpendicular direction so that gravity may take effect. Such devices, therefore, do not allow for use in a prone position because in a prone position the device is not aligned such that gravity may provide direct force.

It would, therefore, be advantageous to have a simple, pelvic floor muscles exerciser that does not rely on gravity and allows for a constantly varying force to be resisted.

SUMMARY OF THE INVENTION

The present invention relates to an apparatus for exercising pelvic floor muscles with oppositional force. In particular, one that provides constantly adjustable and variable force against which the user controls both the contractions of the pelvic muscles and the pull or resistance of the apparatus, thereby providing optimal exercising conditions.

In one embodiment of the present invention, the apparatus for exercising pelvic floor muscles comprises an exerciser having an intra-vaginal section and an extra-vaginal section, the sections being connected by a shaft. The intra-vaginal section is generally smooth and oblong shaped and is made typically of an inert material resistant to bacterial and fungal growth such as a suitable plastic, thermoplastic, latex or like material. The shaft is rigid or semi-rigid, resilient and similarly made of an inert material resistant to bacterial and fungal growth. The extra-vaginal portion is ergonomically shaped so that the user may grasp it firmly The device is operated by insertion of the intra-vaginal portion into the vagina of the user, contraction of the pelvic floor muscles by the user around such intra-vaginal portion and application of force by the user against such muscles along an axis which upon muscle failure would result in extraction of the device from the user's vagina.

These and various other advantages and features of novelty which characterize the invention will be more readily apparent from the following detailed description of the preferred embodiments which proceeds with reference to the accompanying drawings.

DETAILED DESCRIPTION OF THE PREFERRED EMBODIMENTS

The present invention is an apparatus for exercising the pelvic floor muscles.

Figure 1:
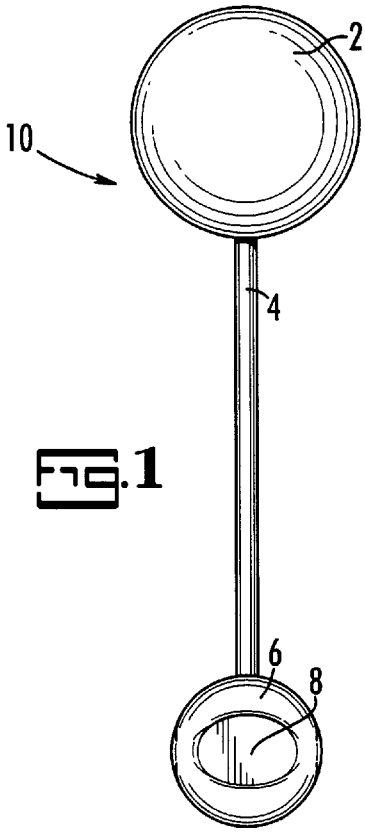
FIG. 1 is a view of a first embodiment of the exercise apparatus in accordance with the present invention.

With reference to FIG. 1, an apparatus 10 is accordance with an embodiment of the present invention is shown. Said apparatus 10 comprises an intra-vaginal portion 2, a shaft 4 connected thereto and a extra-vaginal grasping means 6 connected the opposite end of said shaft 4.

Said intra-vaginal portion 2 is generally spherically shaped. Apparatus 10 has, preferably, a radius of approximately 1.25 inches for the small size, 1.625 inches for the medium size and 2.125 inches for the large size. It is understood that other size intra-vaginal portion 2 may be used as long as they are of a sufficient size to permit the user to squeeze her pelvic floor muscles around said intra-vaginal portion and resist thereby a force applied in a manner and along an axis that upon muscle failure would result in the intra-vaginal portion 2 being removed from the vaginal canal.

The intra-vaginal portion 2 is preferably made of an inert, easy to clean material which resists bacterial and/or fungal growth thereon thereby eliminating risk of infection to the user. Suitable materials for said intra-vaginal portion 2 include, but are not limited to, Nylon, other plastics, thermoplastics, latex rubber and other inert rubbers and the like.

The shaft 4 is a rigid or semi-rigid shaft that is attached at its proximal end to said intra-vaginal portion 2 and connects the intra-vaginal portion 2 with the extra-vaginal grasping means 6 and similarly made of an inert, easy to clean material which resists bacterial and/or fungal growth in order to eliminate the risk of infection to the user. Suitable materials for said shaft 4 include, but are not limited to, Nylon, other plastics, thermoplastics, latex rubber and other inert rubbers and the like. Said shaft 4 is preferably, approximately 4 inches long but may be any length so long as there is sufficient distance between said intra-vaginal portion 2 and said extra-vaginal grasping means 6 to allow the user to place said intra-vaginal portion 2 within the vaginal canal while permitting said extra-vaginal grasping means to be readily accessible to the user and outside said vaginal canal.

The extra-vaginal grasping means 6 is attached to the distal end of said shaft 4. The grasping means of the present invention may be any device that allows a user to grasp said extra-vaginal grasping means 6 firmly. Such means for grasping include but are not limited to the grasping means depicted in FIG. 1 wherein the extra-vaginal grasping means 6 contains a dimpled concave area 8 that permits grasping by the users thumb in apposition to the users index finger. Additional grasping means not shown but useful in the practice of the invention include the use of a ring a hook, a T-shaped grasping means and the like.

Figure 2:
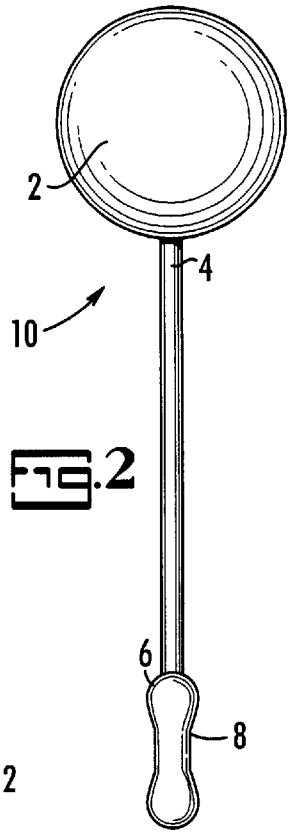
FIG. 2 is a side view of the embodiment described in FIG. 1.

With reference to FIG. 2, the apparatus 10 of figure is shown in a perpendicular, side view in which said dimpled concave area 8 of said extra-vaginal grasping means 6 is depicted.

Figure 3:
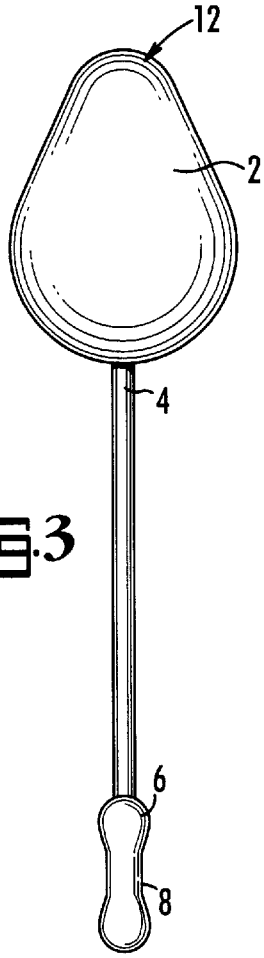
FIG. 3 is a view of a second embodiment of the exercise apparatus in accordance with the present invention.
Figure 4A:
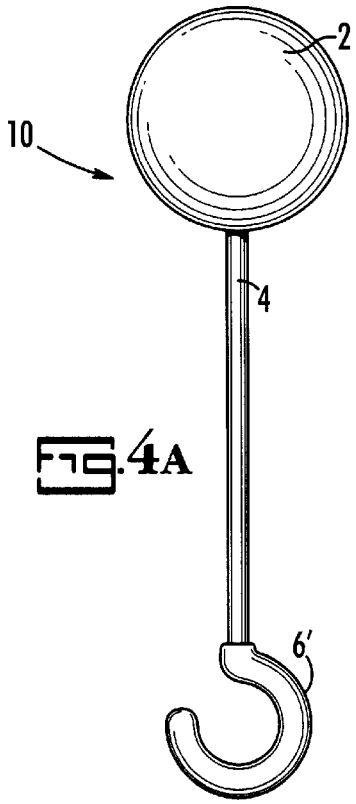
FIGS. 4A, 4B AND 4C illustrate three alternative embodiments of the handle of the apparatus shown in FIG. 1.
Figure 4B:
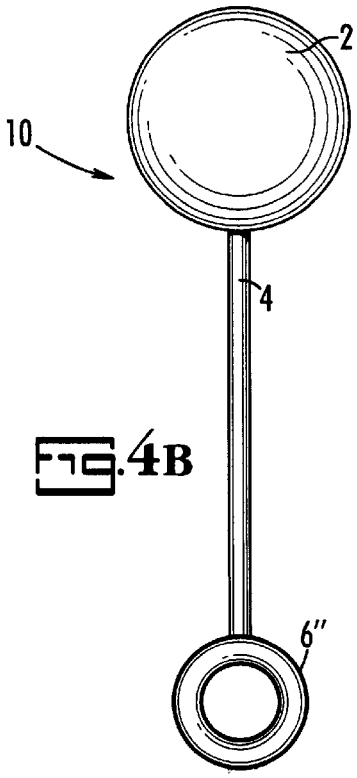
Figure 4C:
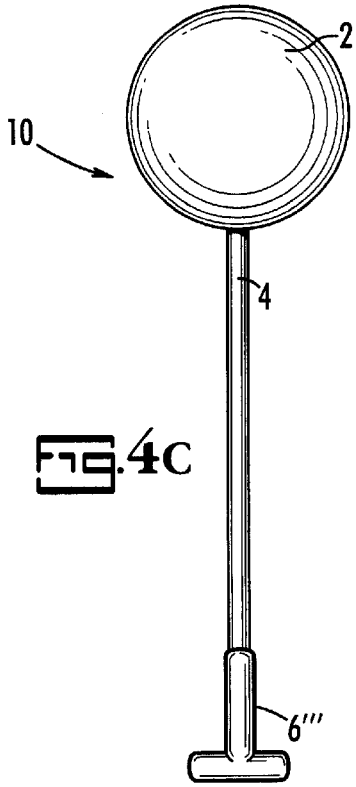

With reference to FIG. 3, an alternative embodiment of the present invention is shown in which said intra-vaginal portion 2 is oblong shaped with the insertion end 12 located at the distal side of said intra-vaginal portion 2. In this embodiment said insertion end 12 is tapered to enhance ease of insertion into the vaginal canal. The maximal radius of said intra-vaginal portion 2 is as described above in relation to the apparatus described in FIG. 1.

The apparatuses described above are used by inserting said intra-vaginal portion 2 into the vaginal canal where the user then contracts her pelvic floor muscles around said intra-vaginal portion. Optimal exercise is achieved by the user at some point immediately prior to muscle failure which we define as release of the device from within the vagina. For each user, the amount of force required to achieve failure varies in relationship to muscle strength and tone. Moreover, during the course of an exercise routine the point of failure will vary in relation to muscle fatigue. By using predefined weights it is not possible to constantly optimize the force against which the user must act. The user then grasps said extra-vaginal grasping means 6 and applies force in a direction parallel to said shaft 4 so as to attempt to remove said intra-vaginal portion 2 from said vaginal canal. The apparatuses of the present invention permit the user to exert maximal pressure which is defined as the maximum amount of pressure that can be applied prior to muscle failure or the overcoming of the resistance provided by the user by contraction of said pelvic floor muscles around said intra-vaginal portion 2 resulting in the extraction of said intra-vaginal portion 2 from said vaginal canal. The user can, therefore, maximize the exercise by varying the amount of force used because the user can feel incipient slippage of the intra-vaginal portion 2 from said vaginal canal and adjust that amount of force accordingly.

It will be clear to those skilled in the art of analytical chemistry that many modifications and substitutions can be made without departing from the spirit and scope of the invention, which is defined by the appended claims.

What is claimed is:

1. An apparatus for exercising pelvic floor muscles comprising:

an intra-vaginal portion;

a shaft having a proximal end and a distal end, said intra-vaginal portion being attached thereto at said proximal end; and a ring attached to the distal end of said shaft for grasping said shaft.

2. The apparatus of claim 1, wherein said intra-vaginal portion is egg shaped.

3. The apparatus of claim 2, wherein the diameter of said intra-vaginal portion is 1.25 inches.

4. The apparatus of claim 2, wherein the diameter of said intra-vaginal portion is 1.625 inches.

5. The apparatus of claim 2, wherein the diameter radius of said intra-vaginal portion is 2.125 inches.

6. The apparatus of claim 1, wherein said shaft is 4 inches long.

7. The apparatus of claim 1, wherein said intra-vaginal portion is made of an inert, bacterial and fungal resistant material.

8. The apparatus of claim 7, wherein said inert, bacterial and fungal resistant material is selected from the group consisting of plastics, thermoplastics and inert rubbers.

9. A method of strengthening pelvic floor muscles using a device having an intra-vaginal portion, a shaft having a proximal end and a distal end, said intra-vaginal portion being attached thereto at said proximal end, and grasping means for grasping said shaft attached to said distal end of said shaft, said method comprising the steps of:

inserting said intra-vaginal portion into a vaginal canal;

grasping said grasping means; and pulling on said device while the user contracts the user's pelvic floor muscles around said intra-vaginal portion with sufficient force until said user can feel incipient slippage of the intra-vaginal portion from said vaginal canal.

10. An apparatus for exercising pelvic floor muscles comprising:

an intra-vaginal portion;

a shaft having a proximal end and a distal end, said intra-vaginal portion being attached thereto at said proximal end; and a hook attached to the distal end of said shaft for grasping said shaft.

11. The apparatus of claim 10, wherein said intra-vaginal portion is egg shaped.

12. The apparatus of claim 10, wherein said intra-vaginal portion is made of an inert, bacterial and fungal resistant material.

13. The apparatus of claim 12, wherein said inert, bacterial and fungal resistant material is selected from the group consisting of plastics, thermoplastics and inert rubbers.

14. An apparatus for exercising pelvic floor muscles comprising:

an intra-vaginal portion;

a shaft having a proximal end and a distal end, said intra-vaginal portion being attached thereto at said proximal end; and a T-shaped handle attached to the distal end of said shaft for grasping said shaft.

15. The apparatus of claim 14, wherein said intra-vaginal portion is egg shaped.

16. The apparatus of claim 14, wherein said intra-vaginal portion is made of an inert, bacterial and fungal resistant material.

17. The apparatus of claim 16, wherein said inert, bacterial and fungal resistant material is selected from the group consisting of plastics, thermoplastics and inert rubbers.

* * * * *